US012270619B2

(12) United States Patent
Lavi

(10) Patent No.: US 12,270,619 B2
(45) Date of Patent: Apr. 8, 2025

(54) SELF-ILLUMINATED FIREARM CHAMBER

(71) Applicant: Sagiv Lavi, Kadima (IL)

(72) Inventor: Sagiv Lavi, Kadima (IL)

( * ) Notice: Subject to any disclaimer, the term of this patent is extended or adjusted under 35 U.S.C. 154(b) by 0 days.

(21) Appl. No.: 18/693,890

(22) PCT Filed: Oct. 24, 2023

(86) PCT No.: PCT/IL2023/051096
§ 371 (c)(1),
(2) Date: Mar. 20, 2024

(87) PCT Pub. No.: WO2024/127386
PCT Pub. Date: Jun. 20, 2024

(65) Prior Publication Data

US 2024/0418465 A1 Dec. 19, 2024

(30) Foreign Application Priority Data

Dec. 12, 2022 (IL) ..... 299020

(51) Int. Cl.
*F41A 9/53* (2006.01)
*F41A 9/61* (2006.01)
*F41A 35/00* (2006.01)

(52) U.S. Cl.
CPC *F41A 9/53* (2013.01); *F41A 9/61* (2013.01); *F41A 35/00* (2013.01)

(58) Field of Classification Search
CPC ..... F41A 9/61; F41A 9/62; F41A 9/64; F41A 9/65; F41A 9/72; F41A 9/73; F41A 9/53; F41A 35/00
USPC ..... 42/1.05
See application file for complete search history.

(56) References Cited

U.S. PATENT DOCUMENTS 4,109,401 A * 8/1978 Musgrave ..... F41A 9/62 42/50
9,068,785 B2 * 6/2015 Ball ..... F41A 9/53
10,175,015 B2 * 1/2019 Ball ..... F41A 9/62
2010/0139142 A1 6/2010 Pikielny
2011/0016760 A1 * 1/2011 Longo ..... F41A 9/65 102/513

(Continued)

FOREIGN PATENT DOCUMENTS

DE 102005021703 B3 * 8/2006 ..... F41A 9/70

OTHER PUBLICATIONS

NPL: (https://www.youtube.com/watch?v=YiOzQ8usdV4) "Glow in the dark glock", 2013.*

(Continued)

*Primary Examiner* — John Cooper
(74) *Attorney, Agent, or Firm* — SNELL & WILMER L.L.P.

(57) ABSTRACT

A firearm apparatus configured to fire a bullet of a respective cartridge. The apparatus includes a barrel having an inner-barrel-diameter configured to receive the respective cartridge, an ammunition feeding unit, a firing activator, a cartridge-chamber configured to receive a standard cartridge from the ammunition feeding unit. A rear discharge opening is formed behind the front barrel and aligned with the front barrel. The cartridge-chamber is illuminated by a self-luminous glowing matter that facilitates the user of the firearm apparatus to see the inside of the cartridge-chamber including in limited light conditions.

19 Claims, 8 Drawing Sheets

(56) References Cited

U.S. PATENT DOCUMENTS

| | | | | |
|---|---|---|---|---|
| 2013/0042514 | A1* | 2/2013 | Douglas | F41A 9/65 42/50 |
| 2015/0369551 | A1 | 12/2015 | Ball | |
| 2016/0123687 | A1* | 5/2016 | Cook, Jr. | F41H 3/00 42/50 |
| 2020/0088496 | A1 | 3/2020 | Karchon et al. | |

OTHER PUBLICATIONS

NPL: https://www.youtube.com/watch?v=YiOzQ8usdV4), YouTube video titled "Glow in the dark Glock", 2013.*

International Search Report and Written Opinion dated Jan. 28, 2024 in PCT International Patent Application No. PCT/IL2023/051096, 8 pages.

* cited by examiner

Detailed
A

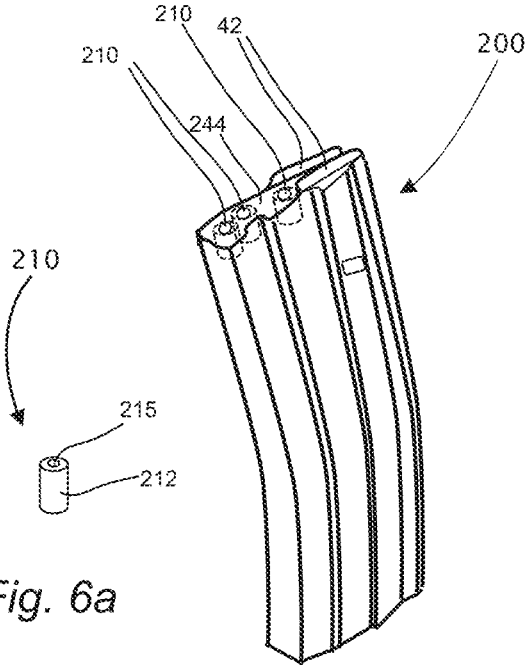
Fig. 6a
Fig. 6b
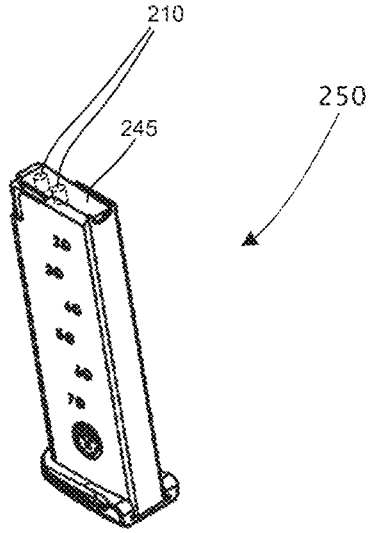
Fig. 6c

SELF-ILLUMINATED FIREARM CHAMBER

FIELD

The present disclosure relates to firearms and more specific to a self-illuminated chamber of a firearm.

BACKGROUND

Often, when a firearm is being used, a non-initiated firing stoppage may occur either by lack in ammunition feeding or by a jam. Typically, lack in ammunition feeding occur when the magazine is emptied out, such as in the case of an automatic firearm or a semi-automatic firearm, or when a belt ends such as in the case of a machine gun. A jam situation may occur when, for example, at least one bullet casing 34 (see examples in FIGS. 1*a*-1*c*) is stuck in the chamber and blocks the next available cartridge 30 from being loaded.

When, for example, a security person is engaged in a combat situation in dark conditions, response time may be critical and every second counts. Hence, in case of a non-initiated firing stoppage, the user can determine, at a glance, whether the firearm-stoppage was caused by a jam or by lack in ammunition feeding from an emptied magazine (or belt).

Currently, none of the means, such as "chamber-loaded indicators" or "light-emitting firearm magazine indicators," allow for the same visual confirmation steps taken in lighted conditions, to be taken in low-light (less than 200 lumen) to zero-light conditions, without the use of an external light source. Furthermore, in case of a non-initiated firing stoppage, they do not facilitate the user of the firearm to determine, at a glance, whether the firearm-stoppage was caused by a jam or by lack in ammunition feeding from an emptied magazine.

There is therefore a need, and it would be advantageous to facilitate a user of a firearm, in particular, with no limitations, an automatic firearm or a semi-automatic firearm, with means to react as quick as possible, in real time, to a stoppage in the firearm, including in dark conditions.

SUMMARY

The present disclosure includes providing a self-illuminated chamber of a firearm, wherein at least one inner wall of the chamber is coated with a self-luminous coat of glowing matter such as a self-luminous paint phosphorus, plutonium, phosphors or the like. At least in the case of automatic firearms or semi-automatic firearms, being used in dark conditions, the self-luminous glowing matter allows the user of the firearm, in case of a non-initiated firing stoppage, to determine at a glance whether the firearm-stoppage was caused by a jam or by lack in ammunition feeding.

In one embodiment, at least one inner wall of the chamber is coated with a self-luminous coat of glowing matter such as a self-luminous paint, phosphorus, plutonium, phosphors or the like. At least in the case of automatic firearms or semi-automatic firearms, being used in dark conditions, the self-luminous glowing matter allows the user of the firearm, in case of a non-initiated firing stoppage, to determine at a glance whether the firearm-stoppage was caused by a jam or by lack in ammunition feeding.

In one embodiment, a firearm apparatus is disclosed for firing at least one bullet of a respective cartridge. The apparatus can include a barrel having an inner-barrel-diameter configured to receive the respective cartridge, an ammunition feeding unit, a firing activator, a cartridge-chamber configured to receive a standard cartridge from the ammunition feeding unit. The cartridge-chamber is formed by a number of wall surfaces. A rear discharge opening is formed behind the front barrel, aligned with the front barrel. The standard cartridge includes a casing that includes a primer and encloses a sealed inner-casing space that contains gunpowder. Upon activating the primer by the firing activator, the primer explodes to thereby detonate the gunpowder, forming propellant gases inside the standard cartridge that are directed both forward and backward as follows:

a) forward: firing of the bullet via the front barrel; and b) backward: pushing, by a recoil force Fp, the casing, being a counterweight to the bullet, to thereby eject the casing from the firearm apparatus via the rear discharge opening and the cartridge-chamber.

The propellant gases drive the next standard cartridge from the ammunition feeding device, via the cartridge-chamber toward the front barrel; and wherein the cartridge-chamber is illuminated by a self-luminous glowing matter, and wherein the self-luminous glowing matter facilitates a user of the firearm apparatus to see the inside of the cartridge-chamber, when the cartridge-chamber is not enclosed, including in very low light (less than 200 lumen) to zero light conditions.

In one embodiment, the at least one of the wall surfaces of the cartridge-chamber is coated by the self-luminous glowing matter to thereby illuminate the cartridge-chamber.

In one embodiment, the ammunition feeding unit is a firearm magazine, wherein the firearm magazine includes a pair of lips configured to house the next cartridge to be fired, and wherein the respective upper surfaces of the upper lips are coated by the self-luminous glowing matter to thereby illuminate the cartridge-chamber.

In one embodiment, the self-luminous glowing matter is enclosed inside an embeddable vial, wherein the embeddable vial has a light emitting window, and wherein the light emitting window is configured to direct the emitted light towards the cartridge-chamber to thereby illuminate the cartridge-chamber.

In one embodiment, the light emitting window is coupled to operate with a lens that is configured to disperse the emitted light towards the cartridge-chamber to thereby enhance the illumination of the cartridge-chamber.

In one embodiment, the firearm magazine includes a magazine follower, wherein one or more of the embeddable vials are embedded in the magazine follower, and wherein the respective light emitting windows are facing the cartridge-chamber to thereby illuminate the cartridge-chamber.

In one embodiment, the one or more self-light-emitting units are embedded in the frontal section of the magazine follower.

In one embodiment, the one or more of the embeddable vials are embedded inside selected cartridge-chamber walls, and wherein the respective light emitting windows are facing the cartridge-chamber to thereby illuminate the cartridge-chamber.

In one embodiment, the illuminated cartridge-chamber allows the user of the firearm apparatus, in case of a non-initiated firing stoppage, to determine at a glance, whether the firearm-stoppage is caused by a jam or by lack in ammunition feeding.

In one embodiment, the self-luminous glowing matter is a self-luminous paint.

In one embodiment, a firearm apparatus is disclosed to fire at least one bullet of a cartridge. The firearm apparatus can include a barrel including an inner-barrel-diameter configured to receive the at least one bullet. A rear discharge opening is positioned behind and aligned with said barrel. A cartridge-chamber includes a plurality of wall surfaces and configured to receive from an ammunition feeding unit, a standard cartridge including a casing that includes a primer and encloses a sealed inner-casing space including gunpowder. The ammunition feeding unit includes a firearm magazine with a pair of lips configured to house a next cartridge to be fired. The pair of lips includes upper surfaces coated by a self-luminous glowing matter configured to illuminate said cartridge-chamber. Upon activating the primer by a firing activator of the firearm apparatus, the primer explodes to thereby detonate the gunpowder, forming propellant gases inside the cartridge to drive a next cartridge from said ammunition feeding unit, via said cartridge-chamber toward said front barrel. The propellant gases are directed in a forward direction by firing of the at least one bullet via said barrel; and in a backward direction by pushing, by a recoil force Fp, the casing, being a counterweight to the bullet causing the casing to be ejected from the firearm apparatus via said rear discharge opening and said cartridge-chamber.

In one embodiment, said self-luminous glowing matter is enclosed inside an embeddable vial including a light emitting window.

In one embodiment, said light emitting window is configured to direct emitted light towards said cartridge-chamber to thereby illuminate said cartridge-chamber.

In one embodiment, said wherein said firearm magazine includes a magazine follower, wherein one or more of said embeddable vials are embedded in said magazine follower, and wherein the respective said light emitting windows are facing said cartridge-chamber to thereby illuminate said cartridge-chamber.

In one embodiment, said one or more of said embeddable vials are embedded inside selected cartridge-chamber walls, wherein said one or more of said embeddable vials are embedded inside selected cartridge-chamber walls, wherein the respective said light emitting windows are facing said cartridge-chamber to thereby illuminate said cartridge-chamber.

In one embodiment, a method is disclosed that includes upon activating a primer by a trigger of the firearm apparatus, the primer explodes causing gunpowder to detonate and form propellant gases inside a cartridge to drive a next cartridge from an ammunition feeding unit, a cartridge-chamber toward a barrel including an inner-barrel-diameter configured to receive a bullet, the gunpowder being in a sealed inner-casing space of a standard cartridge including a casing that includes the primer, the cartridge-chamber including a plurality of wall surfaces and configured to receive the standard cartridge from ammunition feeding unit. The method includes directing the propellant gases (a) in a forward direction by firing of the bullet of the standard cartridge via said barrel; and (b) in a backward direction by pushing, by a recoil force Fp, the casing, being a counterweight to the bullet causing the casing to be ejected from the firearm apparatus via a rear discharge opening and said cartridge-chamber, the rear discharged opening being behind and aligned with said barrel.

In one embodiment, the method includes illuminating, by the self-luminous glowing matter, said cartridge-chamber.

In one embodiment, the method includes enclosing said self-luminous glowing matter inside an embeddable vial including a light emitting window.

In one embodiment, the method includes directing emitted light towards said cartridge-chamber to illuminate said cartridge-chamber.

In one embodiment, the method includes dispersing, by a lens in communication with a lighting emitting window of the vial, emitted light towards said cartridge-chamber to illuminate said cartridge-chamber.

To the accomplishment of the foregoing and related ends, certain illustrative aspects are described herein in connection with the following description and the appended drawings. These aspects are indicative, however, of but a few of the various ways in which the principles of the claimed subject matter may be employed and the claimed subject matter is intended to include all such aspects and their equivalents. Other advantages and novel features may become apparent from the following detailed description when considered in conjunction with the drawings.

BRIEF DESCRIPTION OF THE DRAWINGS

The present disclosure will become fully understood from the detailed description given herein below and the accompanying drawings, which are given by way of illustration and example only and thus not limitative of the present disclosure, and wherein:

FIG. 6*a* illustrates a self-light-emitting unit, which is similar to prior art self-light-emitting units shown in FIG. 5*b*, adapted for is in firearms built according to the present disclosure.

FIG. 6*b* illustrates a number of self-light-emitting units (the three self-light-emitting units are shown by way of example only) embedded on the top surface of the follower of a respective firearm magazine.

FIG. 6*c* illustrates a number of self-light-emitting units (the two self-light-emitting units are shown by way of example only) embedded on the top surface of the follower of a respective firearm magazine of a handgun.

DETAILED DESCRIPTION

The present disclosure will now be described more fully hereinafter with reference to the accompanying drawings, in which preferred embodiments of the disclosure are shown. This disclosure may, however, be embodied in many different forms and should not be construed as limited to the embodiments set forth herein; rather, these embodiments are provided, so that this disclosure will be thorough and complete, and will fully convey the scope of the disclosure to those skilled in the art.

An embodiment is an example or implementation of the disclosures. The various appearances of "one embodiment," "an embodiment" or "some embodiments" as well as "aspects" do not necessarily all refer to the same embodiment. Although various features of the disclosure may be described in the context of a single embodiment, the features may also be provided separately or in any suitable combination. Conversely, although the disclosure may be described herein in the context of separate embodiments for clarity, the disclosure may also be implemented in a single embodiment.

Reference in the specification to "one embodiment", "an embodiment", "one aspect", "some aspects", "other aspects", "some embodiments" or "other embodiments" means that a particular feature, structure, or characteristic described in connection with the embodiments is included in at least one embodiment, but not necessarily all embodiments, of the disclosures. It is understood that the phraseology and terminology employed herein are not to be construed as limiting and are for descriptive purpose only.

Meanings of technical and scientific terms used herein are to be commonly understood as to which the disclosure belongs, unless otherwise defined. The present disclosure can be implemented in the testing or practice with methods and materials equivalent or similar to those described herein.

Figure 2:
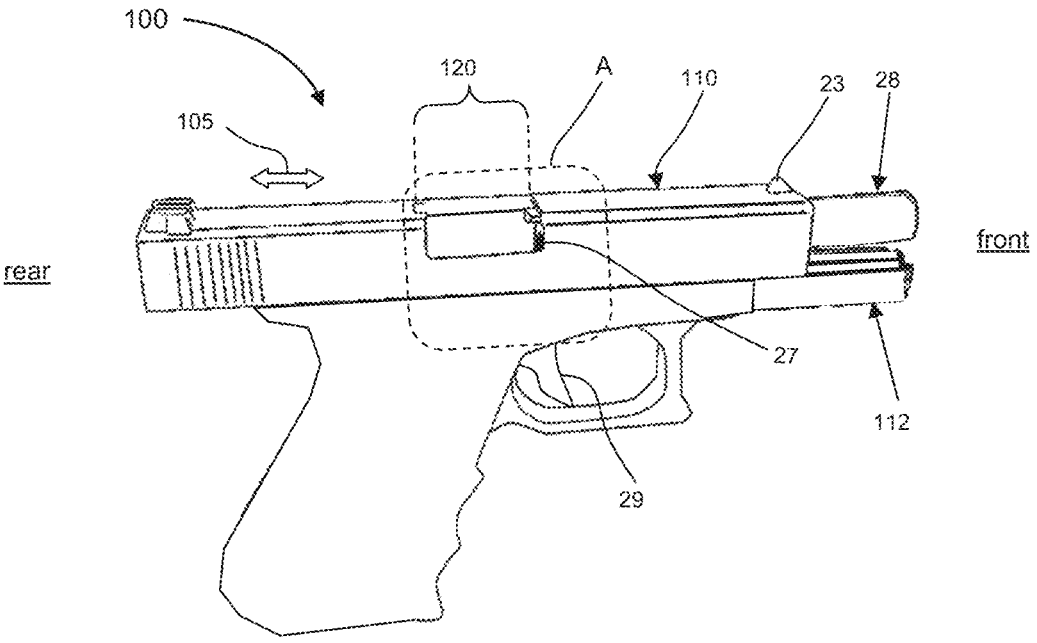
FIG. 2 is a side perspective view illustration of an example a firearm being in a loading state, according to aspects of the present disclosure, wherein chamber of the firearm is a self-illuminated chamber.

It should be noted that orientation related descriptions such as "front", "rear", "bottom", "up", "upper", "down", "lower", "top" and the like, assumes that the associated item, such as the firearm system or a portion thereof, is operationally situated (see FIG. 2).

Reference is made back to the drawings.

Figure 1A:
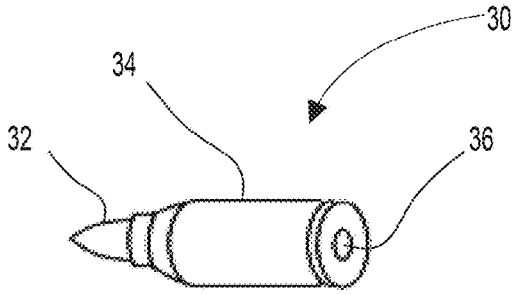
Fig. 1a Prior Art
FIG. 1*a* (prior art) illustrates a common, prior art of a cartridge having a bullet having a bullet casing and a primer.

FIG. 1*a* illustrates a common, prior art of a cartridge 30 having a bullet 32 having a bullet casing 34 and a primer 36.

Figure 1B:
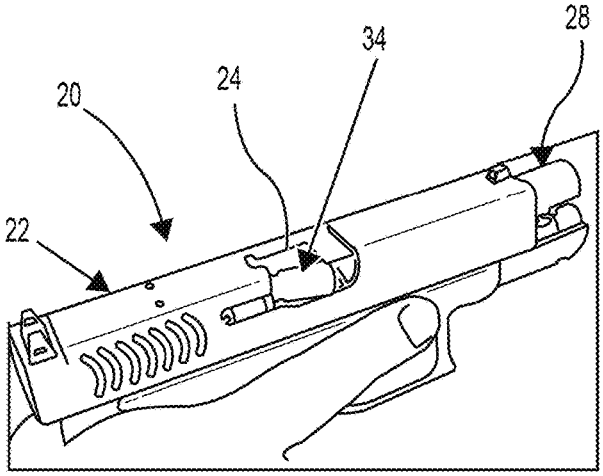
Fig. 1b Prior Art
FIG. 1*b* (prior art) illustrates a common semi-automatic pistol, the pistol being jammed by a bullet casing.

FIG. 1*b* illustrates a common semi-automatic pistol 20, the pistol being jammed by a bullet casing 34. Thereby, a slider 22 of pistol 20 is stuck in a rear position, leaving chamber 24 of pistol 20 in an exposed, open state.

Figure 1C:
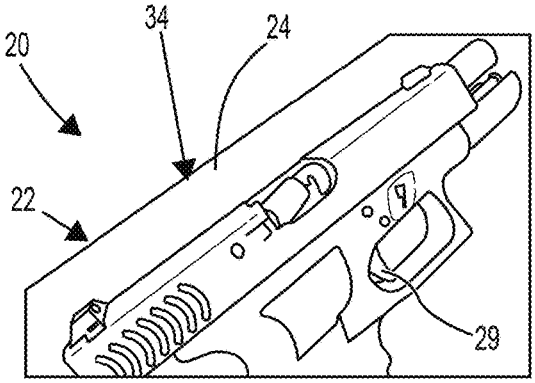
Fig. 1c Prior Art
FIG. 1*c* (prior art) illustrates a common semi-automatic pistol, the pistol being jammed by a bullet casing, preventing the next cartridge from being loaded.

FIG. 1*c* illustrates a common semi-automatic pistol 20, the pistol being jammed by a bullet casing 34, preventing the next cartridge 30 from being loaded, and here too, slider 22 of pistol 20 is stuck in a rear position, leaving chamber 24 of pistol 20 in an exposed, open state.

U.S. Pat. No. 9,395,129 given to Michael Leroy Ball discloses a light-emitting magazine indicator that is integrated into the magazine follower but placed at the rear most section of the follower. However, cannot be seen in a glance. When a magazine is inserted into the firearm. A fully-loaded transparent magazine, with the light-emitting magazine indicator installed, will clearly make known to the firearms operator the current remaining cartridges in the magazine. The light emitting means may receive its energy source from the use of gaseous tritium light sources, which is one type of radio-luminescent material. However, the chamber 24 of firearm 20, remain dark in low-light (less than 200 lumen) to zero-light conditions.

U.S. Pat. No. 9,068,785 given to Michael Leroy Ball, discloses a chamber status indicator for a firearm such as a handgun, rifle, or shotgun is disclosed. The chamber status indicator includes a self-illuminating substance such as a gaseous tritium light source or self-illuminating paint, wherein light from the self-illuminating substance is visible only when a cartridge is loaded in the chamber. Hence, the chamber status indicator does not illuminate the chamber itself. The self-Illuminated light source, such as gaseous tritium light sources, which is one type of radio-luminescent material, the key ingredient being tritium However, the chamber 24 of firearm 20, remain dark in low-light (less than 200 lumen) to zero-light conditions.

FIG. 2 is a side perspective view illustration of a non-limiting example of a firearm apparatus 100, being in a loading state, according to aspects of the present disclosure. The cartridge-chamber 120 is shown open to allow feeding of the firearm apparatus 100, revealing some of the inner walls 122 of the self-illuminated cartridge-chamber 120. In the loading state, a slider 110 of firearm apparatus 100 is slidably moved backwards on a lower receiver 112. In an armed state, slider 110 is slidably moved forward on lower receiver 112 to and thereby bring firearm apparatus 100 to the armed state, in which state firearm apparatus 100 is ready to fire.

It is an aspect of the present disclosure that cartridge-chamber 120 of firearm apparatus 100 is a self-illuminated cartridge-chamber 120, wherein at least one inner wall 122 of the self-illuminated cartridge-chamber 120 is coated with a self-luminous coat of glowing matter such as a self-luminous paint, phosphorus, plutonium, phosphors or the like.

Figure 3:
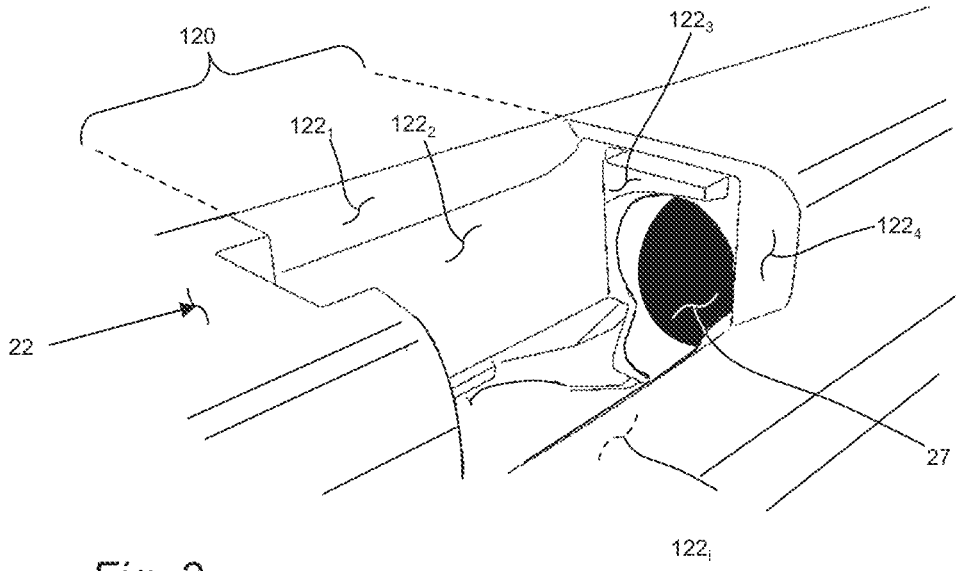
FIG. 3 is a detailed top-side perspective view A, as denoted in FIG. 2, showing a number of coated inner walls of the self-illuminated chamber of a firearm, according to aspects of the present disclosure.

FIG. 3 is a detailed top-side perspective view A, as denoted in FIG. 2, showing a number of coated inner walls 122 of the self-illuminated cartridge-chamber 120 of a firearm apparatus 100, according to aspects of the present disclosure. FIG. 3 also reveals the rear end 27 of barrel 28 of firearm apparatus 100.

It should be appreciated that when firearm apparatus 100 is being used in an automatic or semi-automatic firing mode and is expected to be in an armed state, upon a stoppage event, the user checks the chamber state, expecting it to be in an armed state. In lighted conditions or in limited light conditions (e.g., low-light (less than 200 lumen) to zero-light conditions), the user can determine, at a glance, whether the firearm-stoppage was caused by a jam or by lack in ammunition feeding from an emptied magazine.

When a firearm such as firearm 20 is used in low-light to zero-light conditions the user cannot determine, at a glance, whether the firearm-stoppage was caused by a jam or by lack in ammunition feeding from an emptied magazine, without the use of an external light source, when firearm apparatus 100 is being used, the coated inner walls 122 of the self-illuminated cartridge-chamber 120 of a firearm apparatus 100 glow. Thereby, the user can determine in any light conditions, at a glance, whether the firearm-stoppage was caused by a jam or by lack in ammunition feeding from an emptied magazine.

Firearm apparatus 100 for firing at least one bullet 32 of a respective cartridge 30, includes a barrel having an inner-barrel-diameter configured to receive the respective cartridge 30. Apparatus 100 can include an ammunition feeding unit such as a magazine. Apparatus 100 can include a firing activator such as a trigger 29. Apparatus 100 can include a cartridge-chamber 120 configured to receive a cartridge 30 from the ammunition feeding unit; and a rear discharge opening 27 formed behind the front barrel 28, aligned with the front barrel 28. The standard cartridge includes a casing, wherein the casing encloses a sealed inner-casing space that contains gunpowder, and the casing includes a primer 36. Upon activating primer 36 by firing activator 29, primer 36 explodes to thereby detonate the gunpowder, forming propellant gases inside the standard cartridge 30 that are directed both forward and backward as follows:

a) forward: firing of bullet 32 via the front barrel 28; and
b) backward: pushing, by a recoil force Fp, the casing 34, being a counterweight to bullet 32, to thereby eject the casing 34 from firearm apparatus 100 via rear discharge opening 27 and cartridge-chamber 120.

The propellant gases further drive the next standard cartridge 30 from the ammunition feeding device, via cartridge-chamber 120 toward the front barrel 28. The cartridge-chamber 120 is formed by a number of wall surfaces 122, wherein at least one of the wall surfaces 122 is coated by a self-luminous glowing matter, and wherein the self-luminous glowing matter facilitates a user of the firearm apparatus 100 to see the inside of the cartridge-chamber 120, when the cartridge-chamber 120 is not enclosed, including in very low light (less than 200 lumen) to zero light conditions.

The self-luminous glowing matter allows the user of the firearm apparatus 100, in case of a non-initiated firing stoppage, to determine at a glance, whether firearm-stoppage is caused by a jam or by lack in ammunition feeding. Optionally, the self-luminous glowing matter is a self-luminous paint such as, with no limitations, a paint containing phosphorescent material.

Figure 4:
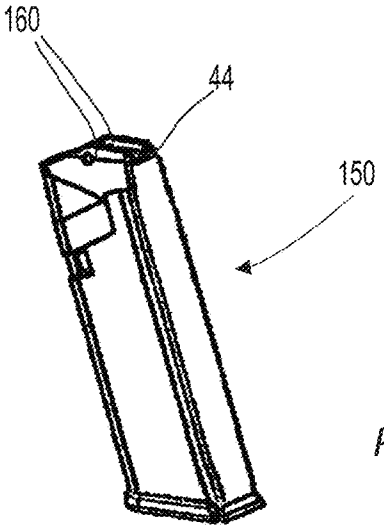
Fig. 4 Prior Art
FIG. 4 illustrates a top perspective view of one example magazine of a firearm, wherein the upper lips of the magazine are coated with self-luminous coat of glowing matter such as a self-luminous paint, according to aspects of the present disclosure.

FIG. 4 illustrates a top perspective view of one example magazine 150 of a firearm apparatus 100, the magazine being the ammunition feeding unit. Magazine 150 includes a pair of upper lips 160 configured to house the next cartridge 30 to be fired by the firearm apparatus 100. According to other aspects of the present disclosure, the respective upper surfaces of upper lips 160 of the magazine are coated with self-luminous coat of glowing matter such as a self-luminous paint, according to aspects of the present disclosure. The glowing upper lips 160 of magazine 150 illuminate cartridge-chamber 120 of a firearm apparatus 100 when in a loading state.

Figure 5B:
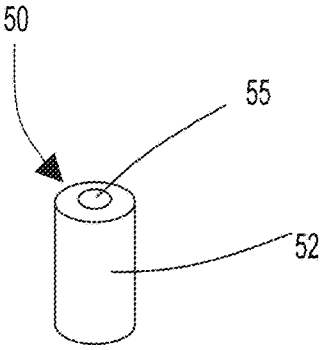
Fig. 5b Prior Art
FIG. 5*b* (prior art) illustrates an example self-light-emitting unit having an embeddable vial with a light emitting window.
Figure 5A:
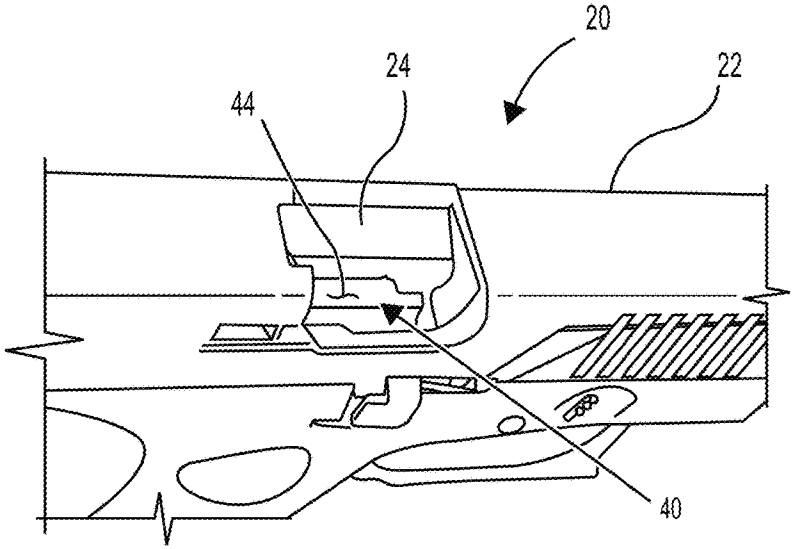
Fig. 5a Prior Art
FIG. 5*a* (prior art) depicts a top perspective view of an example prior magazine of a respective firearm, wherein the firearm chamber is shown in an opened state.

FIG. 5*a* depicts a top perspective view of an example prior art firearm 20 having magazine 40 that includes a magazine follower 44, which, when the magazine is out of ammunition, faces the operator of the firearm 20.

FIG. 5*b* schematically illustrates a top perspective view of a "self-light-emitting indicator 50", having an embeddable vial 52 having a light emitting window 55. The vial 52 can be tiny in size and is hermetically sealed, and can be used as an embeddable component, for example, embedded into an existing firearms assembly or mechanism such as a chamber wall or a selected magazine surface. Typically, the inside of the vial is coated with phosphorescent material, which is available in different colors depending on preference and desired brightness level and is filled with a trace amounts of tritium gas. Emitting electrons that activate the phosphorescent material permanently, without the need of external power, or a charging catalyst.

FIG. 5*a* depicts a top perspective view of an example prior magazine 40 of a respective firearm, wherein the firearm chamber 24 is shown in an opened state. The magazine 40 includes a magazine follower 44, (see for example FIG. 4), placed at the rear most section of the follower 44, which faces the operator of the firearm 20. However, when the firearm is used in dark conditions, the chamber (24) cannot be seen in a glance.

FIG. 5*b* schematically illustrates an example self-light-emitting unit 50 having an embeddable vial 52 with a light emitting window 55.

According to other aspects of the present disclosure, FIG. 6*a* illustrates a self-light-emitting unit 210, which is similar to self-light-emitting unit 50, having an embeddable vial 212 with a light emitting window 215. FIG. 6*b* illustrates, by way of example only, a number of self-light-emitting units 210 (the three self-light-emitting units 210 are shown by way of example only) embedded on the top surface of the follower 244 of a respective firearm magazine 200. Preferably, the one or more self-light-emitting units 210 are embedded in the frontal section of the follower 244. Upon a stoppage event of the firearm—the cartridge-chamber (24) of the firearm is in an opened state, and the one or more self-light-emitting unit 210 glow to thereby illuminate the chamber (24) of the respective firearm. FIG. 6*c* illustrates, by way of example only, a number of self-light-emitting units 210 (the two self-light-emitting units 210 are shown by way of example only) embedded on the top surface of the follower 245 of a respective handgun magazine 250. Preferably, the one or more self-light-emitting units 210 are embedded in the frontal section of the follower 245. Upon a stoppage event of the handgun—the cartridge-chamber (24) of the handgun is in an opened state, and the one or more self-light-emitting unit 210 glow to thereby illuminate the chamber (24) of the respective handgun.

At least in the case of automatic firearms or semi-automatic firearms, when the firearm is used in dark conditions, the self-light-emitting unit(s) 210 allows the user of the firearm, in the case of a non-initiated firing stoppage, to determine at a glance whether the firearm-stoppage was caused by a jam or by lack in ammunition feeding. If the cartridge-chamber is clear and the upper surface of the follower 244 of a respective firearm is clear and no cartridge 30 or bullet casing 34 is viewed, it means that the magazine is out of ammunition.

Figure 7C:
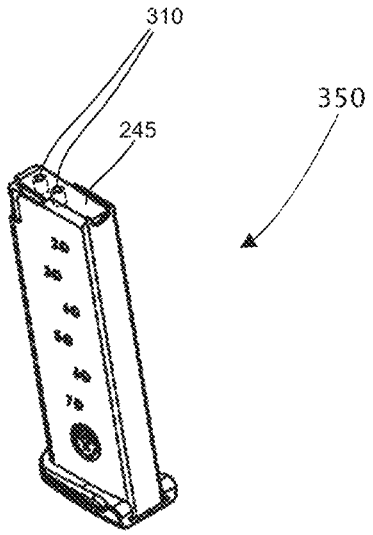
FIG. 7*c* illustrates a number of self-light-emitting units (the two self-light-emitting units are shown by way of example only) embedded on the top surface of the follower of a respective firearm magazine of a handgun, wherein each respective light emitting window is coupled to operate with a lens.
Figure 7B:
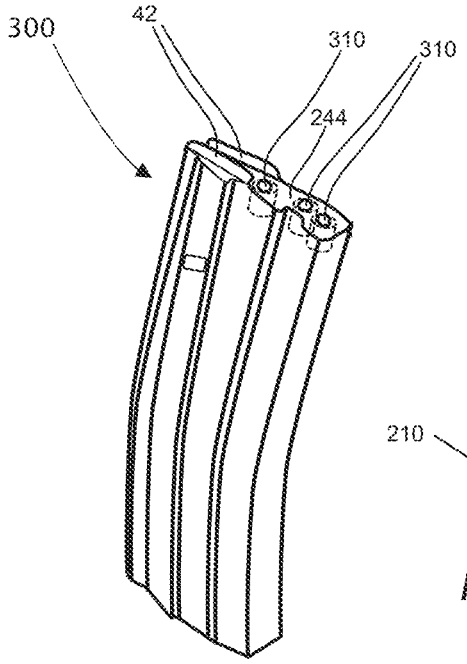
FIG. 7*b* illustrates a number of self-light-emitting units (the three self-light-emitting units are shown by way of example only) embedded on the top surface of the follower of a respective firearm magazine, wherein each respective light emitting window is coupled to operate with a lens.
Figure 7A:
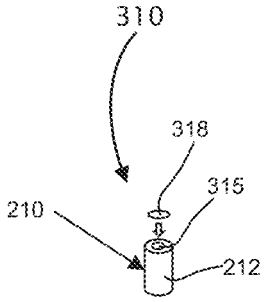
FIG. 7*a* illustrates a self-light-emitting unit, having an embeddable vial with a light emitting window that is coupled to operate with a lens.
Figure 8:
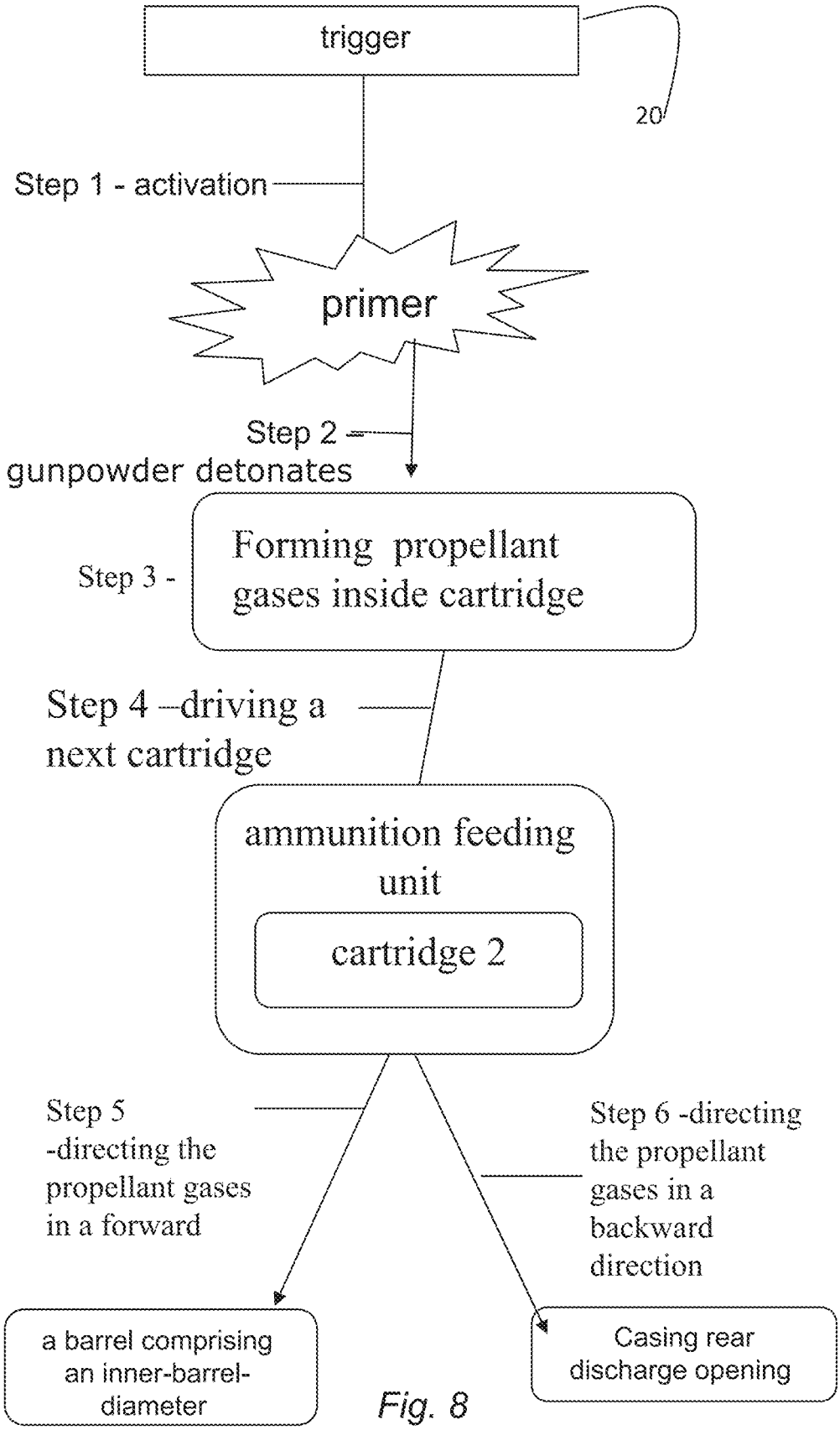
FIGS. 8 & 9 are a flowchart illustrating the method
Figure 9:
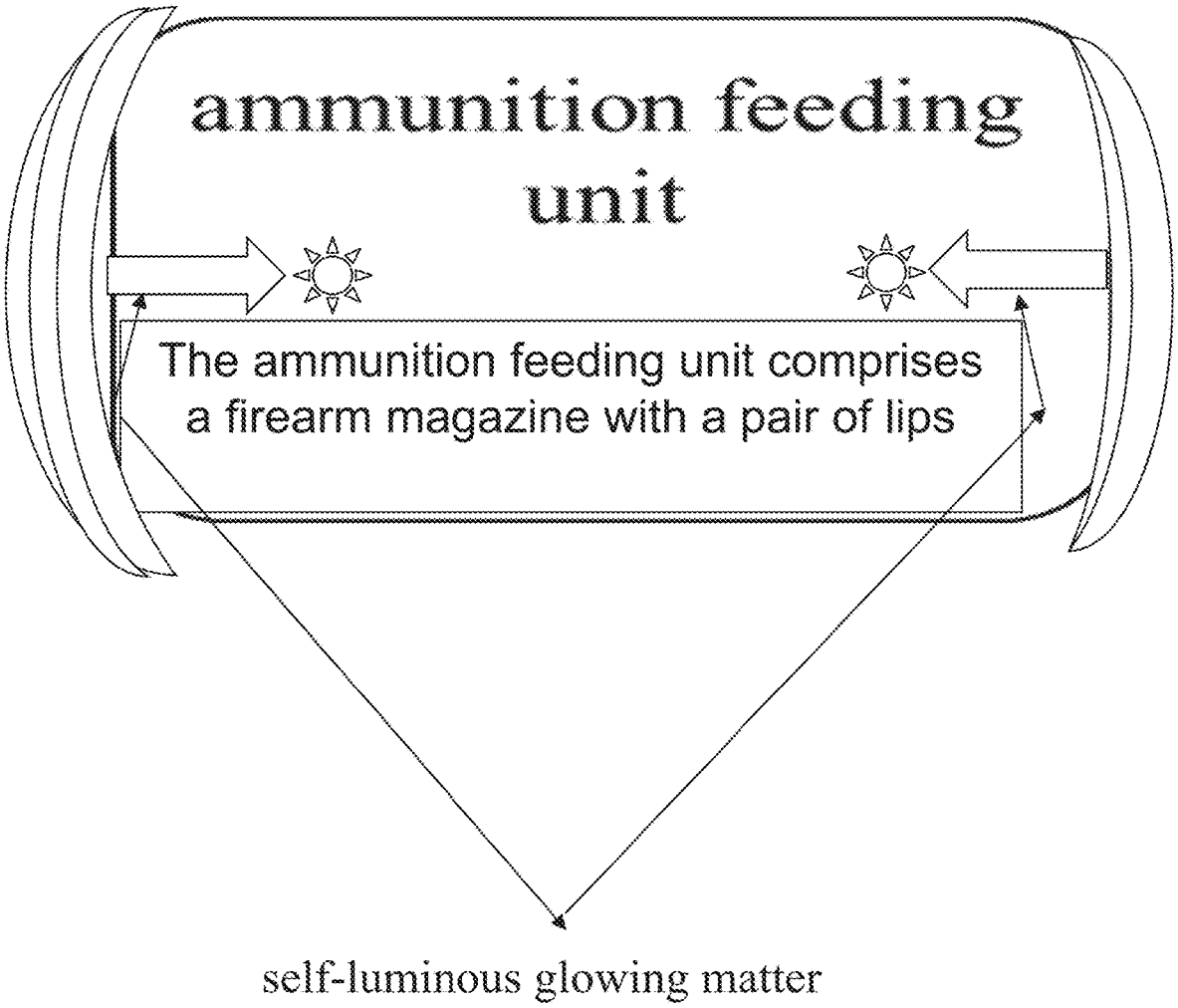

According to other aspects of the present disclosure, FIG. 7*a* illustrates a self-light-emitting unit 310, having an embeddable vial 210 with a light emitting window 315. In addition, light emitting window 315 is coupled to operate with a lens 318 that is configured to disperse the emitted light upwardly, to thereby illuminate the inside of the cartridge-chamber (24) of the respective firearm (20). FIG. 7*b* illustrates, by way of example only, at a number of self-light-emitting unit 310 (the three self-light-emitting units 310 are shown by way of example only) embedded on the top surface of the follower 244 of a respective firearm magazine 300. Preferably, the one or more self-light-emitting units 210 are embedded in the frontal section of the follower 244. Upon a stoppage event of the firearm—the cartridge-chamber (24) of the firearm is in an opened state, and the one or more self-light-emitting unit 310 glow to thereby illuminate the chamber (24) of the respective firearm. FIG. 7*c* illustrates, by way of example only, a number of self-light-emitting units 310 (the two self-light-emitting units 310 are shown by way of example only) embedded on the top surface of the follower 245 of a respective handgun magazine 350. Preferably, the one or more self-light-emitting units 310 are embedded in the frontal section of the follower 245. Upon a stoppage event of the handgun—the cartridge-chamber (24) of the handgun is in an opened state, and the one or more self-light-emitting unit 210 glow to thereby illuminate the chamber (24) of the respective handgun.

At least in the case of automatic firearms or semi-automatic firearms, when the firearm is used in dark conditions, the "self-light-emitting unit(s) (210 or 310") allows the user of the firearm, in the case of a non-initiated firing stoppage, to determine at a glance whether the firearm-stoppage was caused by a jam or by lack in ammunition feeding. If the chamber is clear and the upper surface of the follower 244 of a respective firearm is clear and no cartridge 30 or bullet casing 34 is viewed, it means that the magazine is out of ammunition.

According to other aspects of the present disclosure, one or more of the embeddable vials (212) are embedded inside selected cartridge-chamber walls 122, and wherein the respective light emitting windows (215, 315) are facing the cartridge-chamber to thereby illuminate the cartridge-chamber of firearm apparatus 100.

The disclosure being thus described in terms of several embodiments and examples, it will be obvious that the same may be varied in many ways. Such variations are not to be regarded as a departure from the spirit and scope of the disclosure, and all such modifications as would be obvious to one skilled in the art.

The disclosure further describes a method upon activating a primer by a trigger of the firearm apparatus, the primer explodes causing gunpowder to detonate and form propellant gases inside a cartridge to drive a next cartridge from an ammunition feeding unit, a cartridge-chamber toward a barrel comprising an inner-barrel-diameter configured to receive a bullet, the gunpowder being in a sealed inner-casing space of a standard cartridge comprising a casing that comprises the primer.

The cartridge-chamber comprising a plurality of wall surfaces is configured to receive the standard cartridge from ammunition feeding unit.

The cartridge-chamber comprising a plurality of wall surfaces is configured to direct the propellant gases:

(a) in a forward direction by firing of the bullet of the standard cartridge via said barrel;

(b) in a backward direction by pushing, by a recoil force Fp, the casing, being a counterweight to the bullet causing the casing to be ejected from the firearm apparatus via a rear discharge opening and said cartridge-chamber, the rear discharged opening being behind and aligned with said barrel.

The method wherein the ammunition feeding unit comprises a firearm magazine with a pair of lips configured to house a next cartridge to be fired. Said pair of lips comprising upper surfaces coated by a self-luminous glowing matter. Said cartridge-chamber is illuminated by the self-luminous glowing matter inside an embeddable vial comprising a light emitting window, directing the emitted light towards said cartridge-chamber to illuminate said cartridge-chamber.

The method further comprising a lens communicating with a lighting emitting window of the vial, dispersing the emitted light towards said cartridge-chamber to illuminate said cartridge-chamber.

What is claimed is:

1. A firearm apparatus configured to fire at least one bullet of a cartridge, comprising:

a barrel comprising an inner-barrel-diameter configured to receive the cartridge;

a cartridge-chamber configured to receive the cartridge from an ammunition feeding unit and wherein said cartridge-chamber is formed by a number of wall surfaces; and the ammunition feeding unit comprising a firearm magazine comprising a pair of lips configured to house a next cartridge to be fired, wherein only the wall surfaces and respective upper surfaces of said pair of lips are coated by a self-luminous glowing matter to thereby illuminate only said cartridge-chamber so an inside of said cartridge-chamber is visible, when said cartridge-chamber is not enclosed, including in very low light (less than 200 lumen) to zero light conditions;

a rear discharge opening formed behind said barrel, aligned with said barrel, the cartridge comprising a casing comprises a primer and encloses a sealed inner-casing space that contains gunpowder; and wherein upon activating the primer by a firing activator of the firearm apparatus, the primer explodes to thereby detonate the gunpowder, forming propellant gases inside the cartridge that are directed both forward and backward as follows:

a) forward: firing of the at least one bullet via said barrel; and backward: pushing, by a recoil force $F_p$, the casing, being a counterweight to the at least one bullet, to thereby eject the casing from the firearm apparatus via said rear discharge opening and said cartridge-chamber.

2. The firearm apparatus of claim 1, wherein said illuminated cartridge-chamber allows the user of the firearm apparatus, in case of a non-initiated firing stoppage, to determine at a glance, whether the firearm-stoppage is caused by a jam or by lack in ammunition feeding.

3. The firearm apparatus of claim 1, wherein said self-luminous glowing matter comprises at least one of self-luminous paint, phosphorus, plutonium, phosphors, and tritium.

4. A firearm apparatus configured to fire at least one bullet of a cartridge, comprising:

a barrel comprising an inner-barrel-diameter configured to receive the cartridge;

a cartridge-chamber configured to receive the cartridge from an ammunition feeding unit and wherein said cartridge-chamber is formed by a number of wall surfaces; and the ammunition feeding unit comprising a firearm magazine comprising a pair of lips configured to house a next cartridge to be fired, wherein only the wall surfaces and respective upper surfaces of said pair of lips are coated by a self-luminous glowing matter to thereby illuminate only said cartridge-chamber so an inside of said cartridge-chamber is visible, when said cartridge-chamber is not enclosed, including in very low light (less than 200 lumen) to zero light conditions;

a rear discharge opening formed behind said barrel, aligned with said barrel, the cartridge comprising a casing comprises a primer and encloses a sealed inner-casing space that contains gunpowder; and wherein upon activating the primer by a firing activator of the firearm apparatus, the primer explodes to thereby detonate the gunpowder, forming propellant gases inside the cartridge that are directed both forward and backward as follows:

forward: firing of the at least one bullet via said barrel; and backward: pushing, by a recoil force $F_p$, the casing, being a counterweight to the at least one bullet, to thereby eject the casing from the firearm apparatus via said rear discharge opening and said cartridge-chamber, wherein another self-luminous glowing matter is enclosed inside an embeddable vial, wherein said embeddable vial has a light emitting window.

5. The firearm apparatus of claim 4, wherein said light emitting window is configured to direct the emitted light towards said cartridge-chamber to thereby illuminate said cartridge-chamber.

6. The firearm apparatus of claim 4, wherein said light emitting window is coupled to operate with a lens that is configured to disperse emitted light towards said cartridge-chamber to thereby enhance illumination of said cartridge-chamber.

7. The firearm apparatus of claim 4, wherein said firearm magazine includes a magazine follower, wherein one or more of said embeddable vials are embedded in said magazine follower, and wherein the respective said light emitting windows are facing said cartridge-chamber to thereby illuminate said cartridge-chamber.

8. The firearm apparatus of claim 7, wherein one or more self-light-emitting units are embedded in a frontal section of said magazine follower.

9. The firearm apparatus of claim 4, wherein said one or more of said embeddable vials are embedded inside selected cartridge-chamber walls.

10. The firearm apparatus of claim 9, wherein said one or more of said embeddable vials are embedded inside selected cartridge-chamber walls, wherein the respective said light emitting windows are facing said cartridge-chamber to thereby illuminate said cartridge-chamber.

11. A firearm apparatus configured to fire at least one bullet of a cartridge, comprising:

a barrel comprising an inner-barrel-diameter configured to receive the at least one bullet;

a rear discharge opening positioned behind and aligned with said barrel;

a cartridge-chamber comprising a plurality of wall surfaces, the cartridge-chamber being configured to receive from an ammunition feeding unit, the cartridge comprising a casing that comprises a primer and encloses a sealed inner-casing space comprising gunpowder; and the ammunition feeding unit comprising a firearm magazine with a pair of lips configured to house a next cartridge to be fired, wherein only the wall surfaces of the cartridge chamber and upper surfaces of said pair of lips are coated by a self-luminous glowing matter configured to only illuminate said cartridge-chamber;

wherein upon activating the primer by a firing activator of the firearm apparatus, the primer explodes to thereby detonate the gunpowder, forming propellant gases inside the cartridge, the propellant gases being directed:

a) in a forward direction by firing of the at least one bullet via said barrel; and b) in a backward direction by pushing, by a recoil force $F_p$, the casing, being a counterweight to the bullet causing the casing to be ejected from the firearm apparatus via said rear discharge opening and said cartridge-chamber.

12. The firearm apparatus of claim 11, wherein additional self-luminous glowing matter is enclosed inside an embeddable vial comprising a light emitting window.

13. The firearm apparatus of claim 12, wherein said light emitting window is configured to direct emitted light towards said cartridge-chamber to thereby illuminate said cartridge-chamber.

14. The firearm apparatus of claim 12, wherein said firearm magazine includes a magazine follower, wherein one or more of said embeddable vials are embedded in said magazine follower, and wherein the respective said light emitting windows are facing said cartridge-chamber to thereby illuminate said cartridge-chamber.

15. The firearm apparatus of claim 12, wherein said one or more of said embeddable vials are embedded inside selected cartridge-chamber walls wherein the respective said light emitting windows are facing said cartridge-chamber to thereby illuminate said cartridge-chamber.

16. A method of firing a bullet of a cartridge, comprising:

upon activating a primer by a trigger of a firearm apparatus that comprises a barrel comprising an inner-barrel-diameter configured to receive at least one bullet, a rear discharge opening positioned behind and aligned with said barrel, a cartridge-chamber comprising a plurality of wall surfaces and configured to receive the cartridge from an ammunition feeding unit, the ammunition feeding unit comprising a firearm magazine with a pair of lips configured to house a next cartridge to be fired, wherein only the wall surfaces and respective upper surfaces of said pair of lips are coated by a self-luminous glowing matter to thereby illuminate only said cartridge-chamber so only an inside of said cartridge-chamber is visible, the cartridge comprising a casing that comprises a primer and encloses a sealed inner-casing space comprising gunpowder, the primer explodes causing gunpowder to detonate and form propellant gases inside the cartridge, the cartridge-chamber toward the barrel comprising the inner-barrel-diameter configured to receive the bullet, the gunpowder being in the sealed inner-casing space of the standard cartridge comprising the casing that comprises the primer, the cartridge-chamber comprising the plurality of wall surfaces and configured to receive the cartridge from the ammunition feeding unit;

directing the propellant gases (a) in a forward direction by firing of the bullet of the cartridge via said barrel; and (b) in a backward direction by pushing, by a recoil force $F_p$, the casing, being a counterweight to the bullet causing the casing to be ejected from the firearm apparatus via a rear discharge opening and said cartridge-chamber, the rear discharged opening being behind and aligned with said barrel;

illuminating, by the self-luminous glowing matter, only said cartridge-chamber when in a loading state.

17. The method of claim 16, further comprising:

enclosing said self-luminous glowing matter inside an embeddable vial comprising a light emitting window.

18. The method of claim 17, further comprising:

directing emitted light towards said cartridge-chamber to illuminate said cartridge-chamber.

19. The method of claim 17, further comprising:

dispersing, by a lens in communication with a lighting emitting window of the vial, emitted light towards said cartridge-chamber to illuminate said cartridge-chamber.

* * * * *